US006708861B2

(12) United States Patent
Osuga et al.

(10) Patent No.: US 6,708,861 B2
(45) **Date of Patent: *Mar. 23, 2004**

(54) SUPPLY MECHANISM AND NAIL MAGAZINE FOR CONNECTED NAILS IN NAILING MACHINE

(75) Inventors: Satoshi Osuga, Tokyo (JP); Mitsugu Takezaki, Tokyo (JP)

(73) Assignee: Max Co., Ltd., Tokyo (JP)

( * ) Notice: Subject to any disclaimer, the term of this patent is extended or adjusted under 35 U.S.C. 154(b) by 61 days.

This patent is subject to a terminal disclaimer.

(21) Appl. No.: 09/954,150

(22) Filed: Sep. 18, 2001

(65) Prior Publication Data

US 2002/0033407 A1 Mar. 21, 2002

(30) Foreign Application Priority Data

Sep. 19, 2000 (JP) ..... P2000-283748
Sep. 19, 2000 (JP) ..... P2000-283755
Sep. 19, 2000 (JP) ..... P2000-283759
May 14, 2001 (JP) ..... P2001-143625

(51) Int. Cl.[7] ..... B25C 5/06

(52) U.S. Cl. ..... 227/120; 227/127; 227/135; 227/136

(58) Field of Search ..... 227/136, 119, 227/120, 138, 127, 128, 135; 206/346, 338

(56) References Cited

U.S. PATENT DOCUMENTS 3,266,697 A * 8/1966 Fiedler ..... 227/120
3,437,249 A * 4/1969 Baum ..... 227/120
4,558,811 A * 12/1985 Klaus ..... 227/116
4,784,306 A * 11/1988 Baum ..... 227/113
5,626,274 A * 5/1997 Shkolnikov et al. ..... 227/109
5,738,266 A * 4/1998 Ogawa ..... 227/128
6,499,642 B1 * 12/2002 Amada ..... 227/119

OTHER PUBLICATIONS

Patent Application Publication No. 2002/0060234, application No. 09/987,947, filed Nov. 16, 2001.*

* cited by examiner

*Primary Examiner*—Rinaldi I. Rada
*Assistant Examiner*—Thanh Truong
(74) *Attorney, Agent, or Firm*—Morgan, Lewis & Bockius LLP

(57) ABSTRACT

A supply mechanism for connected nails in a nailing machine is provided. The nailing machine includes a driver for driving the connected nail and a nose having a nail introduction portion and accommodating the driver. The supply mechanism includes a magazine and a pressing member. The magazine includes a nail guide surface connected to the nail introduction portion of the nose, and the nail guide surface has a corner portion on an upper end thereof for supporting nail heads of the connected nails. The pressing member is opposed to the nail guide surface of the magazine. The connected nails are stored in the magazine and held between the nail guide surface and the pressing member, and the connected nails contacted with the nail guide surface are supplied to the nose of the nailing machine.

16 Claims, 8 Drawing Sheets

SUPPLY MECHANISM AND NAIL MAGAZINE FOR CONNECTED NAILS IN NAILING MACHINE

BACKGROUND OF THE INVENTION

1. Field of the Invention

The present invention relates to a supply mechanism and a nail magazine for connected nails in nailing machine. In particular, to a nail magazine into which plural sheets of connected nails can be loaded.

2. Description of the Related Art

Conventionally, as a nail magazine for use in a nailing machine using connected nails such as stick nails or sheet nails composed of a large number of nails connected together by hard paper, there is known a nail magazine of a successively loading type into which two or more sheets of connected nails can be loaded so as to save the time and labor for loading the connected nails.

The nail magazine of this type comprises a nail storage chamber into which a plurality of connected nails can be loaded in parallel to one another, and a pressing member (pressure plate), which is in the shape of plate, of a spring type which can be elastically contacted with side surfaces of the connected nails stored within the nail storage chamber to thereby press the same against one inner wall surface (nail guide surface) of the nail storage chamber. Also, there is disposed a separator which, in linking with a nail feed pawl, can be inserted into between a first row of connected nails and a second row of connected nails to separate them from each other. Thus, when the nail feed pawl reciprocates back and forth to thereby feed the first row of connected nails, the second row of connected nails can be prevented from moving.

The plurality of connected nails loaded into the nail storage chamber are pressed by the pressing member against the nail guide surface of the nail storage chamber which communicates with the nose of the nailing machine. A first row of connected nails contacted with the nail guide surface are fed toward the nose of the nailing machine by a nail feed pawl which can be actuated in linking with a nailing piston of the nailing machine, and the leading nail is loaded into the nose and is then driven out therefrom by the nailing piston.

In the case where the last one of the first row of connected nails is moved ahead of the leading one of a second row of connected nails, the second row of connected nails are pressed by the pressing member against the nail guide surface of the nail storage chamber so that the leading one of the second row of connected nails is contacted with the last one of the first row of connected nails; and, the second row of connected nails are fed by the nail feed pawl, that is, the nails are successively supplied to the nose of the nailing machine.

In order to be able to cope with various connected nails differing in the nail length, in the nail storage chamber, there is disposed a nail guide table of a vertically sliding type for supporting the connected nails from below; that is, the position of the nail guide table can be changed according to the lengths of the nails to thereby adjust the heights of the heads of the nails to a constant level.

Since the conventional nail magazine of a successively loading type is structured such that the vertical positions of the nails are adjusted by the nail guide table of a vertically sliding type, it takes time and labor to adjust the nail guide table each time the kinds of the connected nails are changed.

Further, because the connected nails carried on the nail guide table adjoin each other with their nail heads held level with each other, the breadth of the nail storage chamber must be set substantially equal to the product of the nail head diameter and the number of connected nails, which raises a problem that the breadth of the nail magazine is increased.

Further, as mentioned above, in the conventional nail magazine of a successively loading type, there is disposed a separator for separating a first row of connected nails and a second row of connected nails from each other and thus, when the first row of connected nails are fed, the second row of connected nails can be prevented from moving. In this case, since the connected nails carried on the nail guide table adjoin each other with their nail heads held level with each other, the breadth of the nail storage chamber must be set equal to the sum of the thickness of the separator and the product of the nail head diameter and the number of connected nails, which not only increases the breadth of the nail magazine but also complicates the structure thereof.

SUMMARY OF THE INVENTION

Accordingly, to save the time and trouble for the adjustment of the nail vertical positions and to reduce the size of the nail magazine of a successively loading type, there are raised some problems to be solved. Thus, it is an object of the invention to solve the above problems found in the conventional nail magazine and supply mechanism for a nailing machine.

In order to reduce the size of the nail magazine, the connected nails adjoining each other within the nail magazine may be stored in such a manner that they are shifted vertically to be uneven from each other in the vertical direction, the breadth of the nail magazine can be reduced as much as possible. However, in this case, the nail magazine must be structured such that the respective rows of connected nails can be held stably and also, when a rear row of connected nails are moved to a front row, the movements thereof in the vertical direction can be made positively.

Therefore, to supply a nail magazine which is capable of not only storing a plurality of connected nails unevenly but also controlling the vertical positions of the respective rows of connected nails, there are raised some problems to be solved Thus, it is another object of the invention to solve the above problems found in the conventional nail magazine.

Further, to simplify the structure of a nail magazine of a successively loading type as well as reduce the size and weight of the nail magazine, there are raised some technical problems to be solved. Thus, it is also another object of the invention to solve the above problems found in the conventional nail magazine.

In attaining one of the above object, according to the invention, there is provided a nail magazine for a nailing machine structured such that: a plurality of connected nails are stored in parallel therein, a pressing member is pressed against the side surfaces of the connected nails to thereby hold the plurality of connected nails by and between the pressing member and a nail guide surface within the magazine, and the connected nail that is contacted with the nail guide surface is supplied to the nose of the nailing machine by a nail feed pawl, wherein not only the nail heads of a first row of connected nails are supported on the corner portion of the upper end of the nail guide surface and the nail heads of a second row of connected nails are supported on a nail head support disposed on the pressing member, but also the nail head support is disposed at a higher position than the upper end of the nail guide surface, whereby the nail heads of the first and second rows of connected heads are stored in such a manner that they are shifted vertically from each other.

Further, in attaining one of the above object, according to the invention, there is provided a nail magazine for a nailing machine structured such that: a plurality of connected nails are stored in parallel therein, a pressing member is pressed against the side surfaces of the connected nails to thereby hold the plurality of connected nails by and between the pressing member and a nail guide surface within the magazine, and the connected nail that is contacted with the nail guide surface is supplied to the nose of the nailing machine by a nail feed pawl, wherein not only the nail heads of a first row of connected nails are supported on the corner portion of the upper end of the nail guide surface and the nail heads of a second row of connected nails are supported on a nail head support disposed on the pressing member, but also the nail head support is disposed at a higher position than the upper end of the nail guide surface, whereby the nail heads of the first and second rows of connected heads are stored in such a manner that they are shifted vertically from each other; and also wherein a lever capable of rotating in the vertical direction is disposed upwardly of a connected nails storage portion of the nail magazine, the leading end of the lever is caused to face the upper surfaces of the first row of connected nails by a spring to thereby restrict the upward movements of the first row of connected nails, and, when the second row of connected nails are moved forward to a front row, the nail heads of the second row of connected nails are contacted with the side surface of the lever and are then depressed downward due to the force of the spring to be thereby contacted with the corner portion of the upper end of the guide surface.

Still further, in attaining one of the above object, according to the invention, there is provided a nail magazine for a nailing machine structured such that a plurality of connected nails are stored in parallel therein, the plurality of connected nails are held by and between a pressing member and a nail guide surface existing within the nail magazine, and the connected nails contacted with the nail guide surface are supplied to the nose of the nailing machine by a nail feed pawl. At a position existing upwardly of the pressing member and higher than the upper end of the nail guide surface, there is disposed a nail head support which can be slid in the direction of the nail guide surface by a spring and can be stopped with a clearance between the nail guide surface and itself, the clearance being equal to or larger than the width dimension from one side surface of a nail shaft to the other side surface of the nail head. Further, the nail heads of a first row of connected nails are supported on the corner portion of the upper end of the nail guide surface, the nail heads of a second row of connected nails are supported on the nail head support, the nail heads of the first and second rows of connected nails are stored in such a manner that they are shifted vertically from each other, and, when the first row of connected nails are consumed, the pressing member presses the second rows of connected nails against the nail guide surface, whereby the nail heads of the second rows of connected nails can be detached from the nail head support and can be supported on the corner portion of the upper end of the nail guide surface.

Further, in attaining one of the above object, according to the invention, there is provided a nail magazine for a nailing machine structured such that a plurality of connected nails are stored in parallel therein, the plurality of connected nails are held by and between a pressing member and a nail guide surface existing within the nail magazine, and the connected nails contacted with the nail guide surface are supplied to the nose of the nailing machine by a nail feed pawl. The nail heads of a first row of connected nails are supported on the corner portion of the upper end of the nail guide surface, the nail heads of a second row of connected nails are supported on a nail head support disposed on the pressing member, and the nail head support is disposed at a higher position than the upper end of the nail guide surface, whereby the nail heads of the first and second rows of connected heads are stored in such a manner that they are shifted vertically from each other Further, a check pawl is disposed on the pressing member to thereby prevent the connected nails contacted by the pressing member from moving backwardly.

The present invention is not limited to a nail magazine for a nailing machine. It is apparent that the present invention is also directed to a supply mechanism is for connected nails in a nailing machine.

According to the present invention, the supply mechanism for connected nails in a nailing machine is provided. The nailing machine includes a driver for driving the connected nail and a nose having a nail introduction portion and accommodating the driver. The supply mechanism includes a magazine and a pressing member. The magazine includes a nail guide surface connected to the nail introduction portion of the nose, and the nail guide surface has a corner portion on an upper end thereof for supporting nail heads of the connected nails. The pressing member is opposed to the nail guide surface of the magazine. The connected nails are stored in the magazine and held between the nail guide surface and the pressing member, and the connected nails contacted with the nail guide surface are supplied to the nose of the nailing machine.

Preferably, the supply mechanism further includes a nail head support disposed on the pressing member, wherein plural rows of connected nails are stored in parallel in the magazine and held between the nail guide surface of the magazine and the pressing member.

DETAILED DESCRIPTION OF THE PREFERRED EMBODIMENTS

Figure 1:
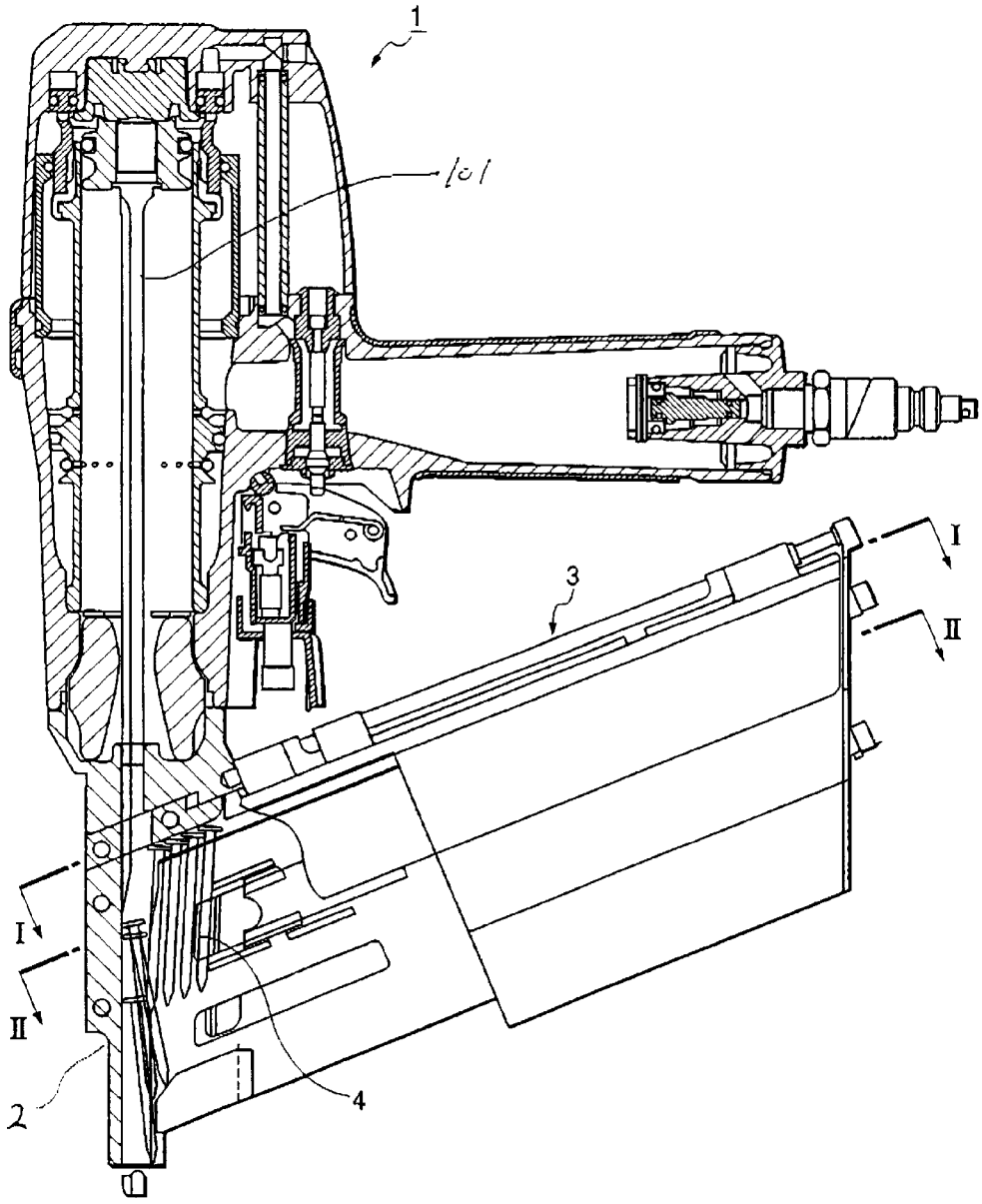
FIG. 1 is a side view of a pneumatic nailing machine showing an embodiment of a supply mechanism and a nail magazine according to the invention.

Now, description will be given below in detail of an embodiment of a supply mechanism and a nail magazine for use in a nailing machine according to the invention with reference to the accompanying drawings. FIG. 1 shows a nailing machine 1 of a pneumatic drive type, in which a nail magazine 3 is connected to the back surface of a nose 2. In the nailing machine 1, the nose 2 is provided with a nail introduction portion 102 (shown in FIG. 2) for receiving a nail from the nail magazine 3. A driver 101 is accommodated in the nose 2 and drives the nail fed to the nose 2 via the nail introduction portion 102. The nail magazine 3 is inclined in such a manner that the front portion thereof comes down according to the shape of the connected nails. The connected nails N loaded into the nail magazine 3 are fed toward the nose 2 and the leading one of the connected nails N is inserted into the nose 2.

Figure 2:
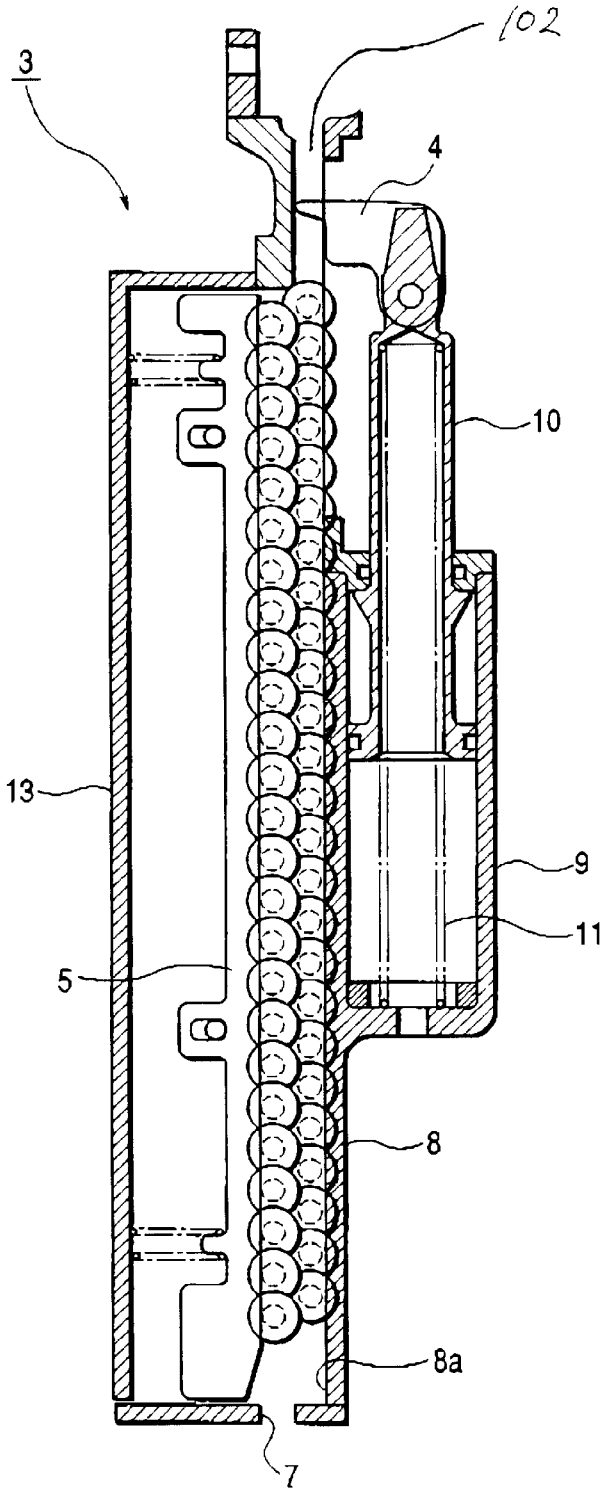
FIG. 2 is a section view of a nail magazine according to the invention, taken along the arrow line I—I shown in FIG. 1.
Figure 3:
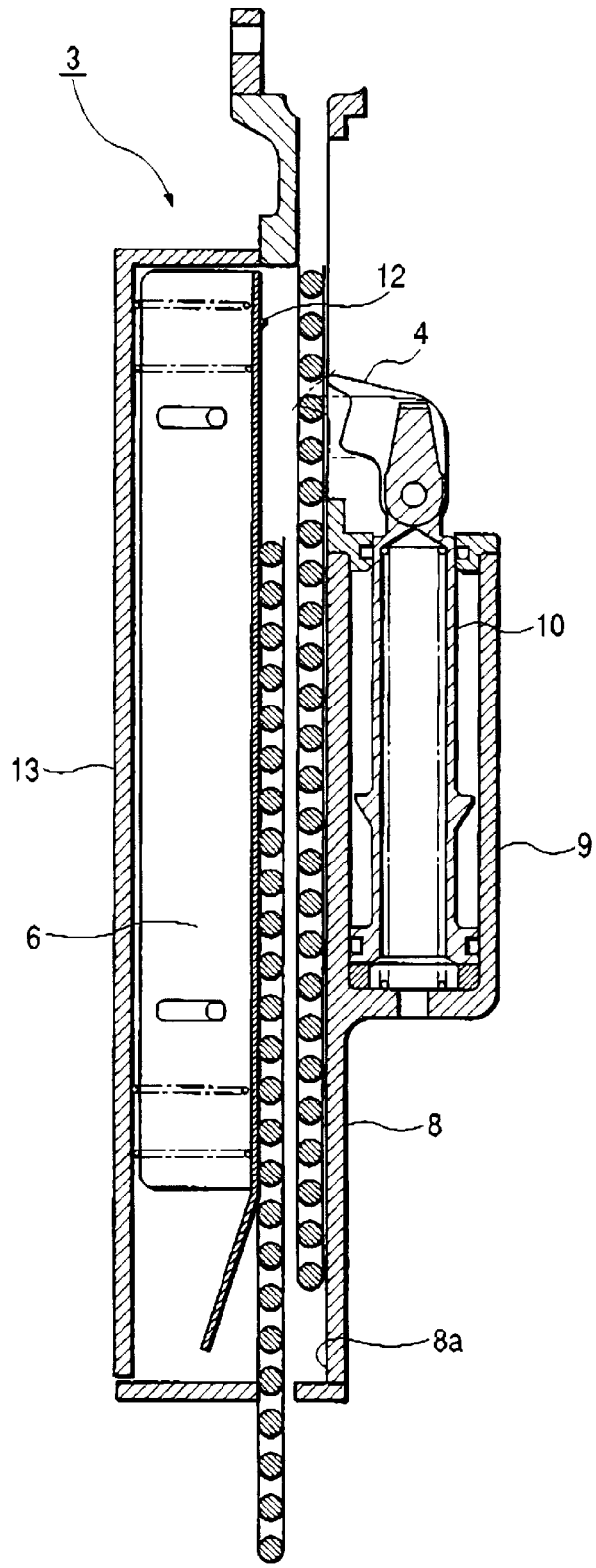
FIG. 3 is a section view of a nail magazine according to the invention, taken along the arrow line II—II shown in FIG. 1.
Figure 4:
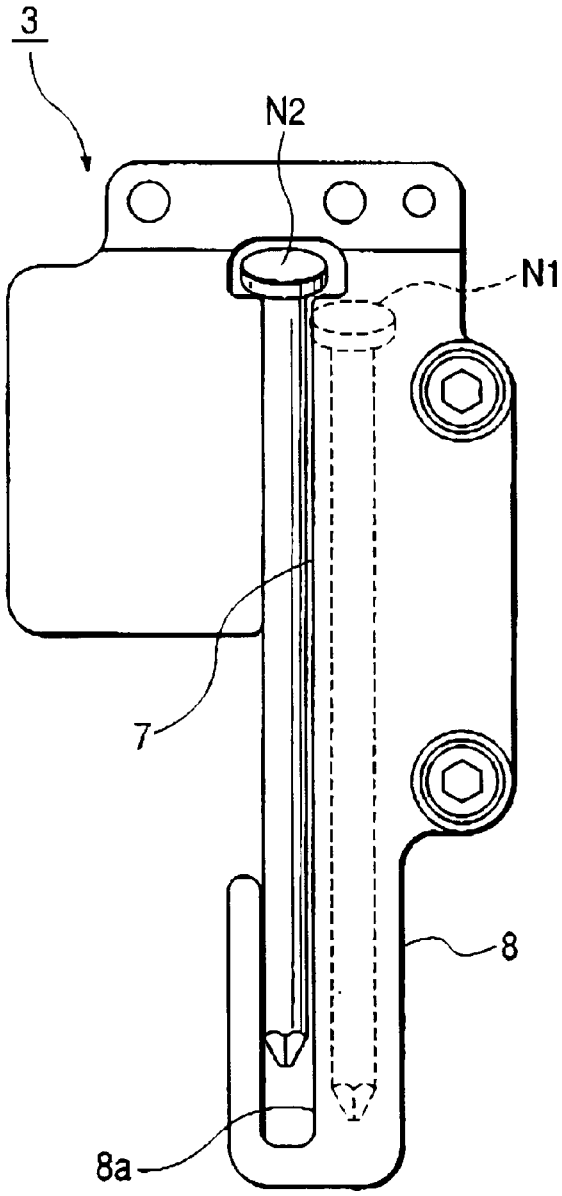
FIG. 4 is a back view of the nail magazine.

FIGS. 2 to 4 respectively show the nail magazine 3. Reference character 5 shown in FIG. 2 designates a nail head support, while 6 shown in FIG. 3 stands for a pressing member 6 (pressure plate), which is in the shape of plate.

In the embodiment shown in FIG. 3, the pressing member is provided inside the nail magazine; however, the pressing member may be provided in another position as long as the pressing member is opposite to a nail guide surface 8*a* of a nail guide rail 8. When inserting the connected nails into a nail loading opening 7 formed in the back surface of the nail magazine shown in FIG. 4, the connected nails N press down the pressing member 6 in the lateral direction and advance into the nail magazine 3. In this manner, two sheets of connected nails N can be loaded into the nail magazine 3 in parallel to each other.

As shown in FIGS. 2 and 3, on the right side surface of the nail guide rail 8 disposed in the nail magazine 3, there is disposed a pneumatic cylinder 9 of a spring return type and, on a piston rod 10 of the pneumatic cylinder 9, there is mounted a nail feed pawl 4 of a ratchet type.

The pneumatic cylinder 9 can be moved back from its front wait position shown in FIG. 2 to its stroke end shown in FIG. 3 by pressure air which is supplied from the blow-back air chamber of the nailing machine 1 and, after then, it can be returned to the front wait position by the force of a spring 11, when the nail feed pawl 4 is engaged with a first row of connected nails N1 to thereby feed the same forward. In the case where the first row of connected nails N1 are fed and the last one thereof advances to a position ahead of the front end portion of a second row of connected nails N2, due to the pressure of the pressing member 6, the front end portion of the second row of connected nails N2 is connected to the last one of the first row of connected nails N1, whereby the first and second rows of connected nails N1, N2 are fed to the nose successively. Also, as shown in FIG. 3, on the front portion of the pressing member 6, there is disposed a check pawl 12 which, when the nail feed pawl 4 retreats, prevents the connected nails from moving backwardly.

The check pawl 12 on the front portion of the pressing member 6 is inserted between the nail shafts of the connected nails contacted with the pressing member 6 to thereby prevent the connected nails from moving backwardly. further, due to this, when the nose of the nailing machine is held so as to face upwardly or when the nail feed pawl is retreated, the connected nails can be prevented from moving outwardly from the nail loading opening 7 or from slipping off therefrom.

Figure 6:
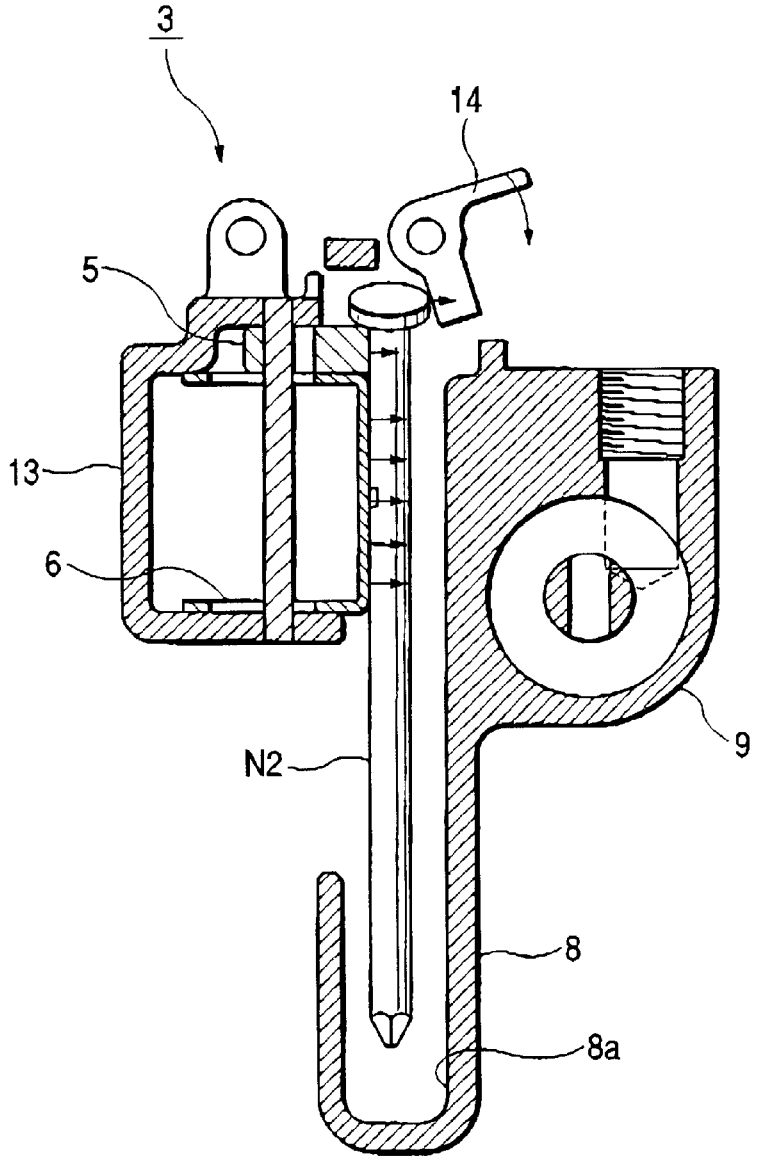
FIG. 6 is a section view of the operation process of the nail magazine.
Figure 7:
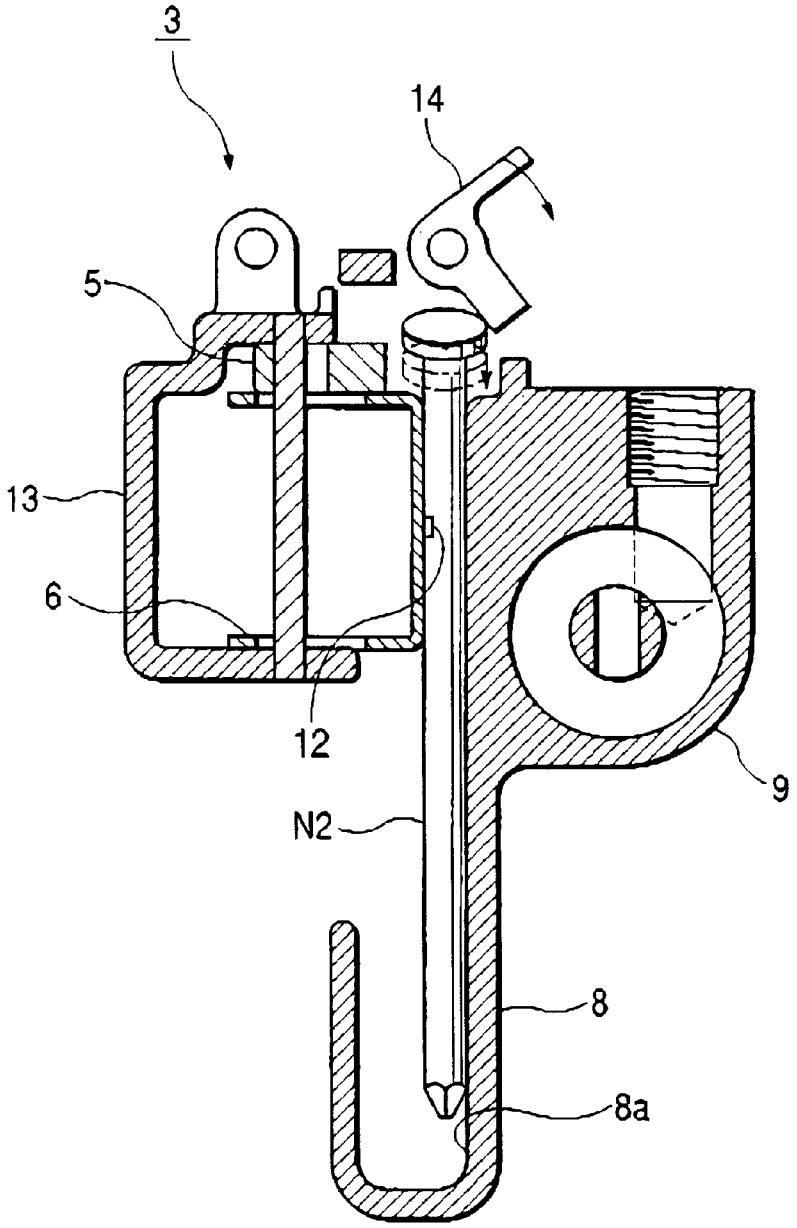
FIG. 7 is a section view of the operation process of the nail magazine.
Figure 8:
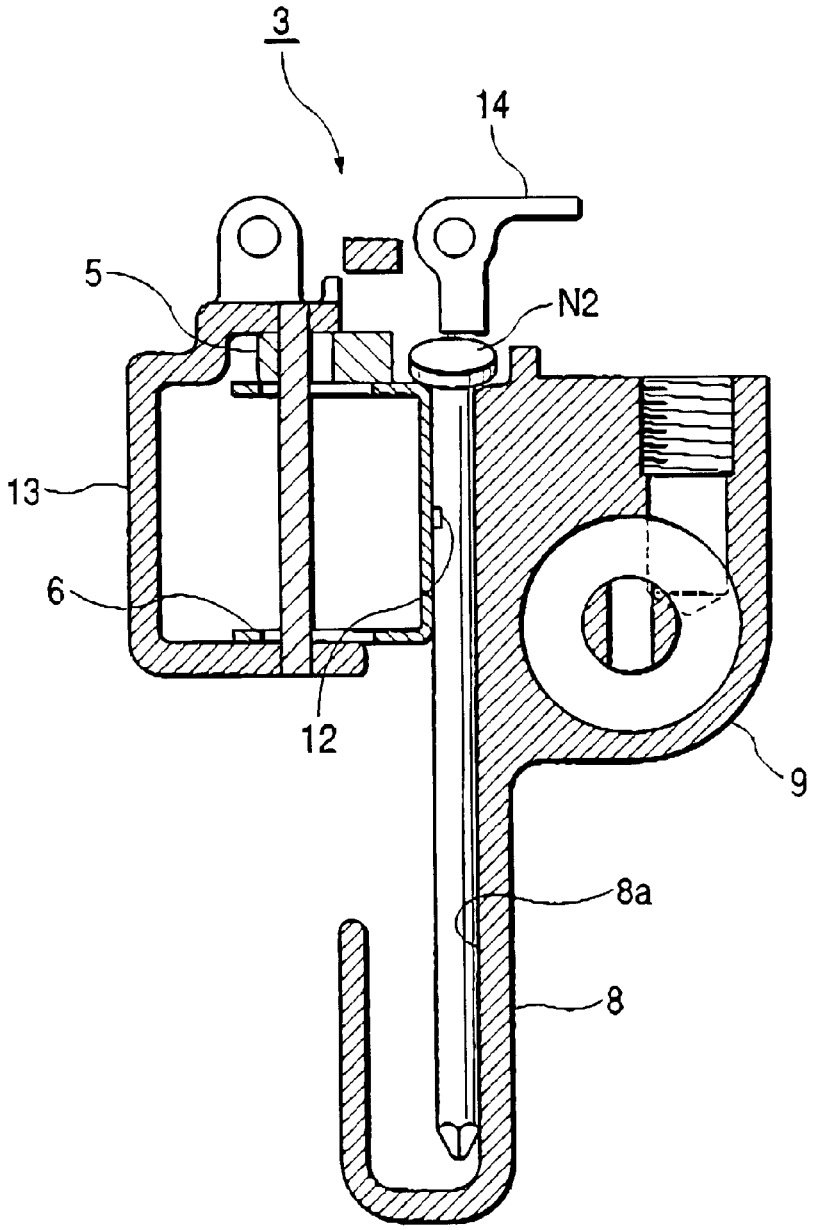
FIG. 8 is a section view of the operation process of the nail magazine.

As shown in FIGS. 5 to 8, the section shape of the nail guide rail 8 of the nail magazine 3 is a J-channel shape, while the pressing member 6 is mounted through a spring (not shown) on a pressing member holder 13 which is disposed opposed to the nail guide surface 8*a* of the nail guide rail 8. On the pressing member 6, there is mounted a nail head support 5 which, similarly to the pressing member, is slidable in the lateral direction, while the nail head support 5 is energized by a spring (not shown) in a direction to project toward the nail guide surface 8*a*. The slide stroke of the nail head support 5 is limited so as to be shorter than the slide stroke of the pressing member 6. The slide stroke of the nail head support 5 is set such that, as shown in FIG. 8, the nail heads of the connected nails cannot be engaged with nor supported on the nail head support 5 but can be engaged with and supported on the respective upper surface corner portions of the pressing member 6 and nail guide rail 8 in the case where a single sheet of connected nails are stored in the nail magazine 3.

Precisely speaking, the slide stroke of the nail head support 5 is limited so as to be shorter than the slide stroke of the pressing member 6 and thus the nail head support 5 stops with a clearance between the nail guide surface 8*a* and itself, the clearance being equal to or larger than the diameter of the nail head. Therefore, as shown in FIG. 8, in the case where a single sheet of connected nails are present within the nail magazine 3, the nail heads of the connected nails held by and between the pressing member 6 and nail guide surface 8*a* are not engaged with the nail head support 5 but are engaged with and supported on the respective upper surface corner portions of the pressing member 6 and nail guide rail 8.

A nail set lever 14, which is disposed just above the first row of connected nails, is energized by a spring (not shown) clockwise in FIGS. 5 to 8 and stops at a position where the leading end thereof faces just downward. In other words, a nail set lever 14 is energized clockwise by a spring, while the leading end of the nail set lever 14 stops at a position which is opposed to the upper surfaces of the first row of connected nails.

Figure 5:
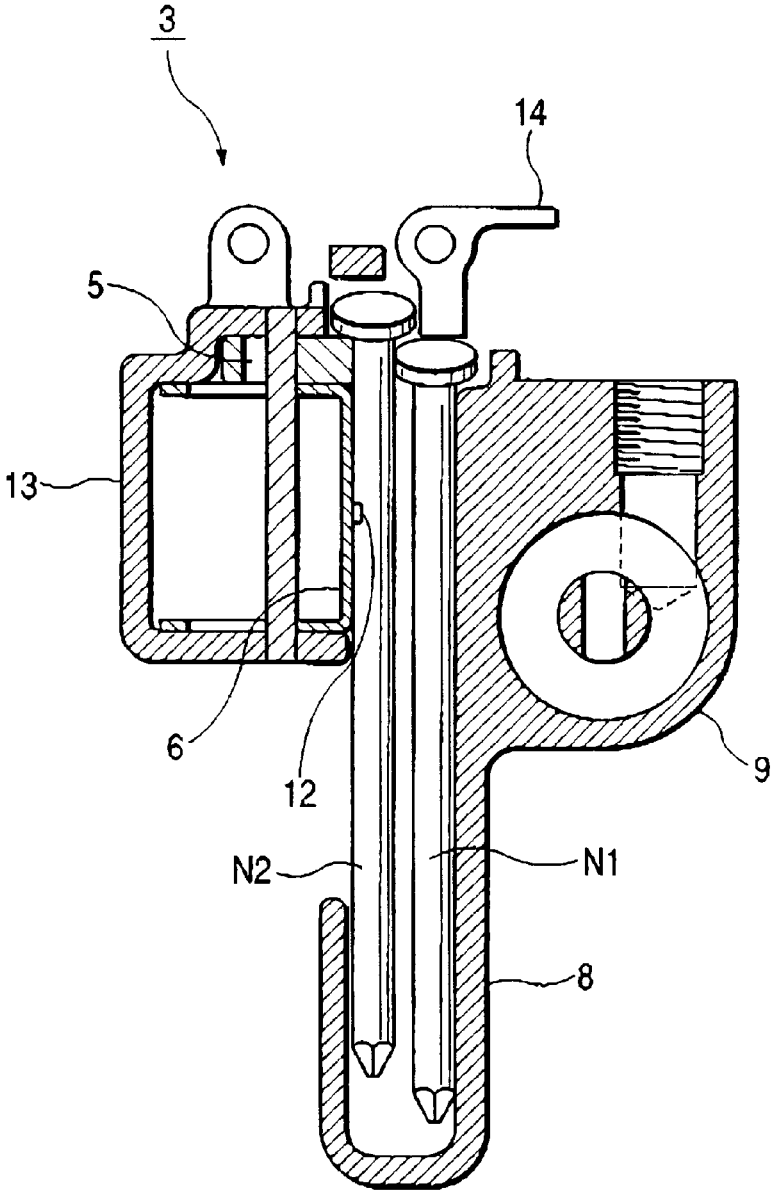
FIG. 5 is a section view of a nail magazine with two sheets of connected nails loaded therein.

Next, description will be given below of the operation of the nail magazine 3. FIG. 5 shows a state in which two sheets of connected nails N1, N2 are loaded within the nail magazine 3. Since the first row of connected nails N1 and the second row of connected nails N2 are stored in such a manner that the positions of their nail heads are shifted in the vertical direction from each other, when compared with the conventional nail magazine in which the nail heads are arranged at the same height, the breadth of the nail magazine can be narrowed.

In the case where the first row of connected nails N1 are consumed and thus advance ahead of the second row of connected nails N2, as shown in FIG. 6, the second row of connected nails N2 with their nail heads engaged with the nail head support 5 are pushed by the pressing member 6 and nail head support 5, and are thereby moved toward the nail guide surface 8*a* of the nail guide rail 8, so that the nail heads of the connected nails N2 are pressed against the set lever 14 to thereby turn the same counterclockwise.

The nail head support 5 stops at a position shown in FIG. 6, whereas the pressing member 6 advances further and presses the connected nails against the nail guide surface 8*a* before it stops. As shown in FIG. 7, at the then time, the nail heads of the connected nails N2 are detached from the nail head support 5 and thus the connected nails N2 are pushed downward due to the rotation torque of the nail set lever 14. As shown in FIG. 8, the nail heads of the connected nails N2 are then engaged with and supported on the upper surface corner portions of the pressing member 6 and nail guide rail 8, so that the second row of the connected nails N2 are set at the same position as the first row of the connected nails N1 shown in FIG. 5.

When nails are loaded into the nail magazine 3 which is empty, a first row of connected nails are set through the above-mentioned steps shown in FIGS. 6, 7 and 8. Further, in the case where a second row of connected nails are then inserted, the nail heads of the second row of connected nails are engaged with the nail head support 5, so that the second row of connected nails N2 are held at a position higher than the first row of connected nails N1.

As described above, since the nail head support of a slide type is disposed at a position higher than the upper end of the nail guide surface, the second row of connected nails and the first row of connected nails stored within the nail magazine are held in such a manner that they are shifted vertically from each other, thereby being able to reduce the space for nail storage. Also, the dimensions of the nail such as the nail shaft diameter and nail head diameter respectively have a certain tolerance and are thus able to cope with two or more kinds of nails. Further, because the slide stroke of the nail head support is limited, the nailing machine can be moved positively from the second row of connected nails to the first row of connected nails.

The present invention is not limited to the above-mentioned embodiment but various changes are also possible without departing from the technical scope of the invention. That is, it goes without saying that such changes also fall within the scope of the invention.

As has been described, in a nail magazine according to the invention, since the connected nails are guided with their heads supported, the vertical positions of the nail heads can be set constant regardless of the lengths of the nails, thereby being able to eliminate the need for execution of the nail support table vertical position adjusting operation in the conventional nail magazine. Further, because plural sheets of connected nails are shifted vertically and are thereby arranged unevenly in the vertical direction, compared with the conventional structure in which connected nails adjoin each other with their nail heads supported at the same height, the breadth of the nail magazine can be narrowed to thereby be able to reduce the size and weight of the nail magazine. That is, the convenience of the nail magazine can be enhanced.

Further, when a second row of connected nails are moved forward to a first row, a lever disposed upwardly of the connected nails storage portion of the nail magazine not only presses down the connected nails to thereby set the connected nails at a given height but also restricts the upward movements of the connected nails, so that the vertical positions of the connected nails can be controlled accurately and the connected nails can be held stably.

Furthermore, the present nail magazine is structured such that, when the second row of connected nails are pushed by the pressing member and are thereby moved forward to a front row, the nail heads of these connected nails can be detached from the nail head support and can be engaged with the upper surface corner portion of the nail guide surface disposed at a position lower than the nail head support. Due to this structure, the connected nails can be moved from upper to lower positions smoothly and stably, which is effective in simplifying the structure of the nail magazine as well as in reducing the size and weight of the nail magazine.

Further, since the check pawl is disposed in the pressing member, although the present nail magazine is a nail magazine of a backward loading type in which the nail insertion opening is formed in the rear end face of the nail magazine, when the nose of the nailing machine is held so as to face upwardly or when the nail feed pawl is retreated, the connected nails can be prevented from slipping off outwardly of the nail loading opening.

What is claimed is:

1. A supply mechanism for connected nails in a nailing machine including a driver for driving one of the connected nails and a nose having a nail introduction portion and accommodating the driver, said supply mechanism comprising:

a magazine including a nail guide surface connected to the nail introduction portion of the nose, said nail guide surface having a corner portion on an upper end of said nail guide surface for supporting nail heads of the connected nails; and a pressing member opposed to said nail guide surface of said magazine, wherein plural rows of connected nails are stored in parallel in said magazine and held between said nail guide surface and said pressing member, and wherein the connected nails contacted with said nail guide surface are supplied to the nose of the nailing machine.

2. The supply mechanism according to claim 1, wherein said pressing member is provided inside said magazine.

3. The supply mechanism according to claim 1, further comprising:

a nail feed pawl for engaging with the connected nail to feed the connected nail to the nose of the nailing machine.

4. A supply mechanism for connected nails in a nailing machine including a driver for driving one of the connected nails and a nose having a nail introduction portion and accommodating the driver, said supply mechanism comprising:

a magazine including a nail guide surface connected to the nail introduction portion of the nose, said nail guide surface having a corner portion on an upper end of said nail guide surface for supporting nail heads of the connected nails;

a pressing member opposed to said nail guide surface of said magazine; and a nail head support disposed on said pressing member, wherein plural rows of connected nails are stored in parallel in said magazine and held between said nail guide surface of said magazine and said pressing member, and wherein the connected nails contacted with said nail guide surface are supplied to the nose of the nailing machine.

5. The supply mechanism according to claim 4, wherein said nail head support is provided at a higher position than the upper end of said nail guide surface of the magazine, and wherein nail heads of the connected nails in a first row are supported on said corner portion of the upper end of said nail guide surface, and nail heads of the connected nails in a second row are supported on said nail head support, so that the nail heads of the connected nails in the first and second rows are stored in such a manner that they are shifted vertically from each other.

6. The supply mechanism according to claim 5, wherein when the connected nails in the first row are consumed, said pressing member presses the connected nails in the second row against said nail guide surface of said magazine, wherein the nail heads of the connected nails in the second row are unsupported by said nail head support and are then supported on said corner portion of the upper end of said nail guide surface.

7. The supply mechanism according to claim 5, further comprising:

a second spring for sliding said nail head support in a direction of said nail guide surface of said magazine, wherein a minimum clearance between said nail guide surface and said nail head support is at least the diameter of a nail shaft plus one-half of the total nail head overhang.

8. The supply mechanism according to claim 5, wherein said pressing member is pressed against side surfaces of the connected nails in one of the first and second rows.

9. A supply mechanism for connected nails in a nailing machine including a driver for driving one of the connected nails and a nose having a nail introduction portion and accommodating the driver, said supply mechanism comprising:

a magazine including a nail guide surface connected to the nail introduction portion of the nose, said nail guide surface having a corner portion on an upper end of said nail guide surface for supporting nail heads of the connected nails;

a pressing member opposed to said nail guide surface of said magazine; and a nail head support disposed on said pressing member;

wherein the connected nails are stored in said magazine and held between said nail guide surface and said pressing member, wherein the connected nails contacted with said nail guide surface are supplied to the nose of the nailing machine, wherein plural rows of connected nails are stored in parallel in said magazine and held between said nail guide surface of said magazine and said pressing member, wherein said nail head support is provided at a higher position than the upper end of said nail guide surface of the magazine, and wherein nail heads of the connected nails in a first row are supported on said corner portion of the upper end of said nail guide surface, and nail heads of the connected nails in a second row are supported on said nail head support, so that the nail heads of the connected nails in the first and second rows are stored in such a manner that they are shifted vertically from each other;

said supply mechanism further comprising:

a rotating lever disposed above a connected nails storage portion of said magazine; and a first spring to restrict upward movements of the connected nails in the first row, wherein a leading end of said lever is caused to face upper surfaces of the connected nails in the first row by said spring, and wherein, when the connected nails in the second row are moved to the first row, the nail heads of the connected nails in the second row are contacted with a side surface of said lever and are then depressed downward due to a force of said spring to be thereby contacted with said corner portion of the upper end of said nail guide surface.

10. A supply mechanism for connected nails in a nailing machine including a driver for driving one of the connected nails and a nose having a nail introduction portion and accommodating the driver, said supply mechanism comprising:

a magazine including a nail guide surface connected to the nail introduction portion of the nose, said nail guide surface having a corner portion on an upper end of said nail guide surface for supporting nail heads of the connected nails;

a pressing member opposed to said nail guide surface of said magazine; and a nail head support disposed on said pressing member;

wherein the connected nails are stored in said magazine and held between said nail guide surface and said pressing member, wherein the connected nails contacted with said nail guide surface are supplied to the nose of the nailing machine, wherein plural rows of connected nails are stored in parallel in said magazine and held between said nail guide surface of said magazine and said pressing member, wherein said nail head support is provided at a higher position than the upper end of said nail guide surface of the magazine, wherein nail heads of the connected nails in a first row are supported on said corner portion of the upper end of said nail guide surface, and nail heads of the connected nails in a second row are supported on said nail head support, so that the nail heads of the connected nails in the first and second rows are stored in such a manner that they are shifted vertically from each other, and wherein said pressing member includes a check pawl to prevent the connected nails contacting said pressing member from moving backwardly.

11. A nail magazine for a nailing machine, comprising:

a nail guide surface;

a pressing member opposed to said nail guide surface; and a nail head support disposed on said pressing member and provided at a higher position than an upper end of said nail guide surface, wherein rows of connected nails are stored in parallel in said nail magazine and held between said nail guide surface and said pressing member, and wherein the connected nails contacted with said nail guide surface are supplied to a nose portion of the nailing machine, and wherein nail heads of the connected nails in a first row are supported on a corner portion of the upper end of said nail guide surface, and nail heads of the connected nails in a second row are supported on said nail head support, so that the nail heads of the connected nails in the first and second rows are stored in such a manner that they are shifted vertically from each other.

12. The nail magazine according to claim 11, wherein when the connected nails in the first row are consumed, said pressing member presses the connected nails in the second row against said nail guide surface, wherein the nail heads of the connected nails in the second row are unsupported by said nail head support and are then supported on said corner portion of the upper end of said nail guide surface.

13. The nail magazine according to claim 11, further comprising:

a second spring for sliding said nail head support in a direction of said nail guide surface, wherein a minimum clearance between said nail guide surface and said nail head support is at least the diameter of a nail shaft plus one-half of the total nail head overhang.

14. The nail magazine according to claim 11, wherein said pressing member is pressed against side surfaces of the connected nails in one of the first and second rows.

15. A nail magazine for a nailing machine, comprising:

a nail guide surface;

a pressing member opposed to said nail guide surface; and a nail head support disposed on said pressing member and provided at a higher position than an upper end of said nail guide surface, wherein rows of connected nails are stored in parallel in said nail magazine and held between said nail guide surface and said pressing member, wherein the connected nails contacted with said nail guide surface are supplied to a nose portion of the nailing machine, and wherein nail heads of the connected nails in a first row are supported on a corner portion of the upper end of said nail guide surface, and nail heads of the connected nails in a second row are supported on said nail head support, so that the nail heads of the connected nails in the first and second rows are stored in such a manner that they are shifted vertically from each other;

said nail magazine further comprising:

a rotating lever disposed above a connected nails storage portion of said nail magazine; and a first spring to restrict upward movements of the connected nails in the first row, wherein a leading end of said lever is caused to face upper surfaces of the connected nails in the first row by said spring, and wherein, when the connected nails in the second row are moved to the first row, the nail heads of the connected nails in the second row are contacted with a side surface of said lever and are then depressed downward due to a force of said spring to be thereby contacted with said corner portion of the upper end of said nail guide surface.

16. A nail magazine for a nailing machine, comprising:

a nail guide surface;

a pressing member opposed to said nail guide surface; and a nail head support disposed on said pressing member and provided at a higher position than an upper end of said nail guide surface, wherein rows of connected nails are stored in parallel in said nail magazine and held between said nail guide surface and said pressing member, wherein the connected nails contacted with said nail guide surface are supplied to a nose portion of the nailing machine, wherein nail heads of the connected nails in a first row are supported on a corner portion of the upper end of said nail guide surface, and nail heads of the connected nails in a second row are supported on said nail head support, so that the nail heads of the connected nails in the first and second rows are stored in such a manner that they are shifted vertically from each other, and wherein said pressing member includes a check pawl to prevent the connected nails contacting said pressing member from moving backwardly.

* * * * *